US005872890A

United States Patent [19]

LaCombe

[11] Patent Number: 5,872,890

[45] Date of Patent: Feb. 16, 1999

[54] CARTRIDGE HEATER SYSTEM

[75] Inventor: Thomas David LaCombe, Valley Center, Calif.

[73] Assignee: Watkins Manufacturing Corporation, Vista, Calif.

[21] Appl. No.: 892,340

[22] Filed: Jul. 14, 1997

Related U.S. Application Data

[63] Continuation of Ser. No. 330,181, Oct. 27, 1994.

[51] Int. Cl.[6] ..... F24H 1/10

[52] U.S. Cl. ..... 392/487; 392/488; 392/492; 392/503

[58] Field of Search ..... 392/487–494, 392/501, 503; 219/518, 519, 523

[56] References Cited

U.S. PATENT DOCUMENTS

| | | | |
|---|---|---|---|
| 1,797,712 | 10/1931 | Brodnax et al. | 392/503 |
| 3,934,333 | 1/1976 | Churchill . | |
| 4,107,514 | 8/1978 | Ellson | 392/497 |
| 4,185,187 | 1/1980 | Rogers | 392/487 |
| 4,233,694 | 11/1980 | Janosko et al. . | |
| 4,501,952 | 2/1985 | Lehrke | 392/489 |
| 4,543,469 | 9/1985 | Cunningham | 219/523 |
| 4,682,010 | 7/1987 | Drapeau et al. | 392/488 |
| 4,855,569 | 8/1989 | Wiedemann | 392/487 |
| 4,949,627 | 8/1990 | Nordskog . | |

FOREIGN PATENT DOCUMENTS

| | | |
|---|---|---|
| 0 154 878 | 9/1985 | European Pat. Off. . |
| 1315376 | 12/1962 | France . |

OTHER PUBLICATIONS

Watlow Catalog entitled "Heaters, Sensors and Controls," Nov. 1993.

Drawing labeled "Heater Assembly Model Z".

Drawing labeled "Heating Element 1.5 KW".

*Primary Examiner*—Tu B. Hoang

*Attorney, Agent, or Firm*—Price, Gess & Ubell

[57] ABSTRACT

A linear cartridge heater has a cylindrical heater element and an integral, concentrically-mounted current collector element positioned within a fire retardant chlorinated PVC enclosure. The enclosure includes a unitarily-molded mounting flange for sealingly mounting the cartridge heater, a unitarily-molded special "tee" section interconnected with the mounting flange, and an alignment bushing. The alignment bushing is interconnected with the special "tee" section by a pipe section to form a fluid flow path between the alignment bushing and the special "tee" section. The special "tee" section provides an outlet for discharging heated water and a mounting place for a first thermistor temperature sensor. The alignment bushing mounts a second thermistor sensor and concentrically positions the heater element within the enclosure, such that the water flow rate past the heater element is substantially increased by the change from circular pipe flow into the alignment bushing to annular flow about the heater element.

25 Claims, 3 Drawing Sheets

CARTRIDGE HEATER SYSTEM

This is a continuation of pending prior application Ser. No. 08/330,181, filed on Oct. 27, 1994.

BACKGROUND OF THE INVENTION

1. Field of the Invention

The subject invention relates generally to heating apparatus and, more particularly, to an improved heating system particularly suited for portable spa applications.

2. Description of Related Art

Prior art approaches for heating the water of portable spas have typically employed so-called "tubular heaters" enclosed within a large reservoir-like metal enclosure or housing. The metal enclosure provides a current collector, typically a U. L. required function in such applications. Such systems exhibit a number of drawbacks impairing their reliability and maintainability.

Tubular heating design consists of three major components: a metal tube, known as a sheath, an electrical resistance wire placed approximately in the center of the sheath, and magnesium oxide (MgO) electrical insulation which has been shaken and packed inside the sheath. Although the MgO is an electrical insulator, it is a relatively good conductor of thermal energy. This characteristic allows heat generated by the resistance wire to move outward to the sheath, which ultimately heats the surrounding water. The heater components are initially assembled into a long, straight sheath, which is typically bent into various shapes such as coils or "bow ties," the ends of which are then welded to a mounting plate or housing.

Each bend and weld provides an opportunity for failure of the sheath, resistance wire, and MgO. Sheath material stretches, thins, and becomes metallurgically inferior and susceptible to corrosion. The electrical and mechanical properties of the resistance wire degrade. MgO placement and compaction changes, jeopardizing electrical and thermal performance. Over the typical range of operation, heater resistance wire life is approximately inversely proportional to resistance wire temperature or, more simply, lower operating temperature implies longer life.

As noted above, previous spa heater system designs have used large, reservoir-like metal enclosures. These enclosures have caused reliability problems and added significant cost. The major deficiency of these enclosures is the slow water velocity through them. Water velocity is critical to proper cooling of the heater element. Without adequate velocity, the water adjacent to the sheath may actually boil. When this happens, scale and sediment will be left behind which may cause clogging of filters, ozone injectors, and the heater itself. If the heater sheath develops scale, it may burn out due to resistance wire overheating or fail due to corrosion in the scale area.

Servicing of conventional spa heaters can also require draining of the spa and removing components and other cumbersome procedures.

OBJECTS AND SUMMARY OF THE INVENTION

It is therefore an object of the invention to improve heater apparatus;

It is another object of the invention to provide improved water heating apparatus for spas, portable spas, and the like;

It is another object of the invention to improve the reliability, maintainability, and operational life of water heating apparatus used in conjunction with spas, portable spas, and the like;

It is another object of the invention to eliminate problems inherent in the structure of prior art tubular heater apparatus in various spa applications; and It is another object of the invention to eliminate problems associated with large reservoir-like heater element enclosures.

These and other objects and advantages are achieved according to the invention by a new heater configuration utilizing a cartridge heater with an integral leakage current collector. The cartridge heater and current collector are enclosed in a corrosion-proof, fire retardant polymer housing. The heater and housing are mutually designed to achieve a high water velocity flow about the heater. The high-temperature-resistance housing optimizes heat transfer from the cartridge heater to the circulating water. The housing also accepts temperature sensing probes for temperature regulating and high-limit thermostats.

According to one illustrative manner of embodying the invention, the cartridge heater construction method includes a swaging process, in which the sheath diameter is reduced, resulting in high pressure compaction of internal MgO. There are no bends in the cartridge heater, eliminating the possibility of damaging the MgO or overstressing an element wire by a bending operation.

The preferred cartridge heater further uses a large (¾-inch) diameter 316L stainless steel sheath. This sheath, which may be supported at each end, forms a very strong, stiff, and corrosion-resistant barrier to the heater's external environment. All welds are located in cold sections of the heater, which provides additional resistance to corrosion. The absence of bends is also an advantage to the cartridge heater's sheath; the sheath is not subject to material stretching, stressing, and thinning as occurs during bent tubular heater fabrication.

The cartridge heater enclosure of the illustrative embodiment further optimizes water velocity and heat transfer, which contributes to superior heater life and efficiency. The enclosure is preferably constructed of flame retardant, corrosion-proof polymer designed to outlast any welded metal enclosure. The heater is attached to the enclosure flange by a 316L stainless steel flange and sealed by a double O-ring. The innermost O-ring provides a "corking effect" which allows the heater to be removed and replaced without draining the spa. All disclosed embodiments of the cartridge heater system are separate from the control box, allowing independent servicing of either system.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

The following description is provided to enable any person skilled in the art to make and use the invention and sets forth the best modes contemplated by the inventors of carrying out their invention. Various modifications, however, will remain readily apparent to those skilled in the art, since the generic principles of the present invention have been defined herein specifically to provide a highly reliable, readily manufacturable, and easily serviceable heater apparatus.

Figure 1:
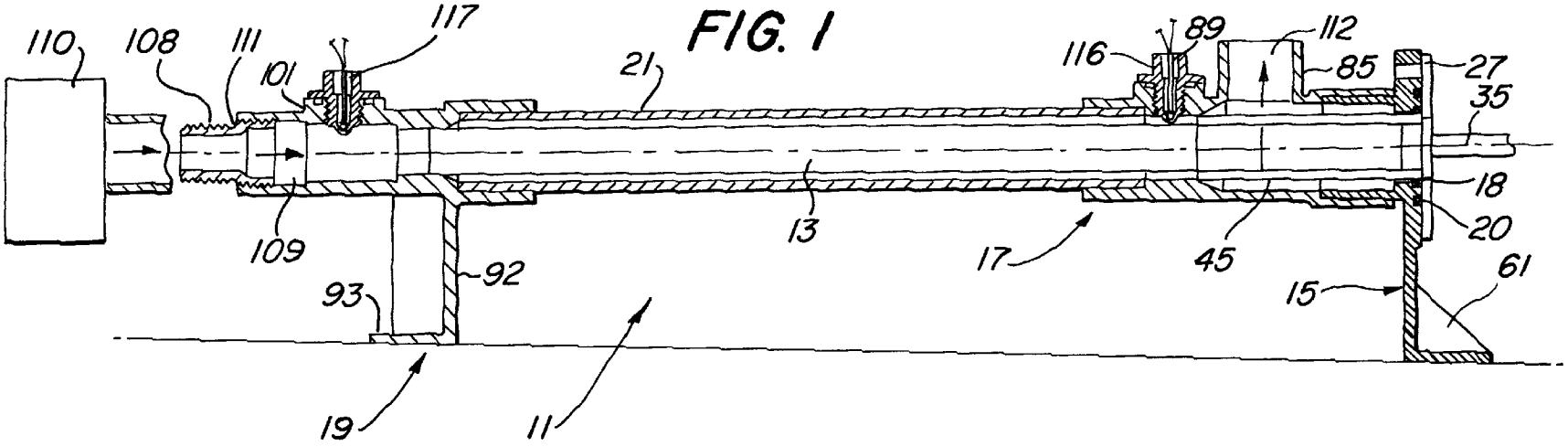
FIG. 1 is a side cross-sectional view of a cartridge heater and enclosure according to the preferred embodiment.

FIG. 1 illustrates heater apparatus 11 for a portable spa unit according to a preferred embodiment of the invention. This apparatus 11 includes a cartridge heater 13, a cartridge heater mounting flange 15, a special tee section 17 to which the mounting flange 15 is attached, and a heater alignment bushing 19. A length of rigid polymer pipe 21 interconnects the special tee section 17 with the alignment bushing 19 and thereby encases the cartridge heater 13 and provides a continuous fluid flow path.

Figure 2:
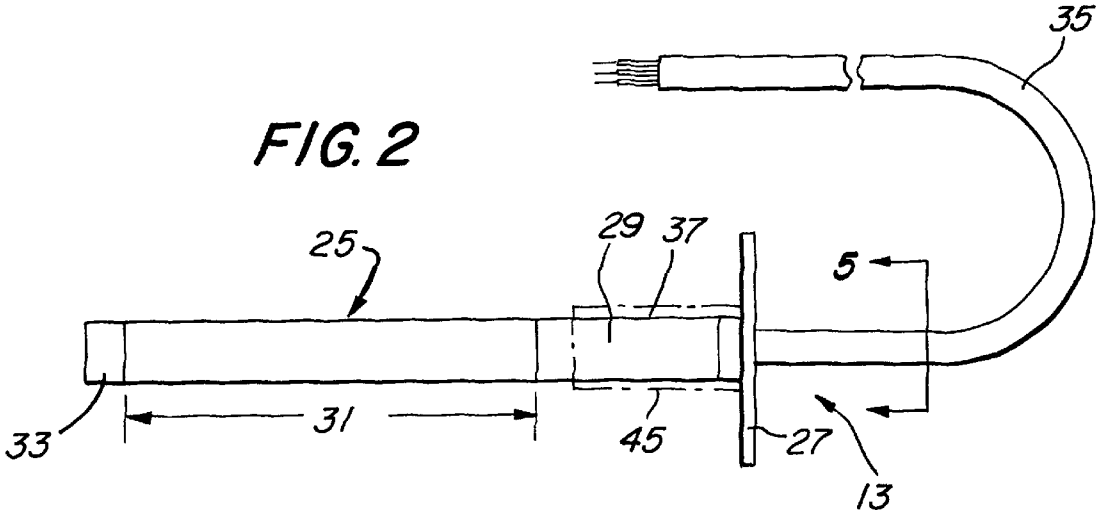
FIG. 2 is a side view of a cartridge heater according to the preferred embodiment.
Figure 5:
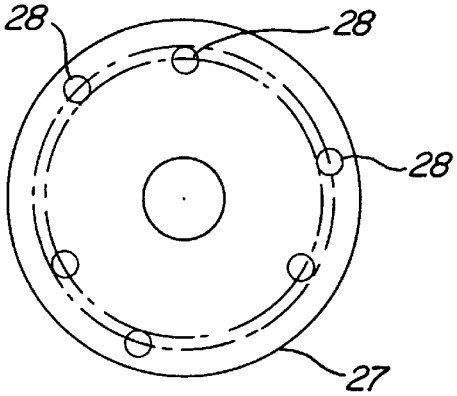
FIG. 5 is an end sectional view taken at 5—5 of FIG. 2.
Figure 6:
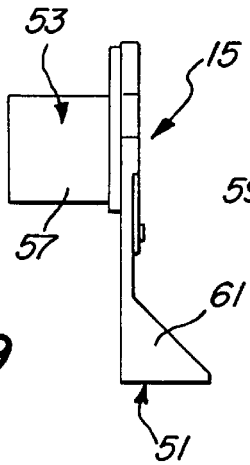
FIG. 6 is a side view of a cartridge heater mounting flange according to the preferred embodiment.
Figure 7:
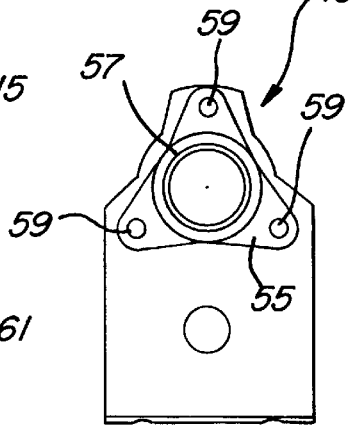
FIG. 7 is a back view of the mounting flange of FIG. 6.
Figure 8:
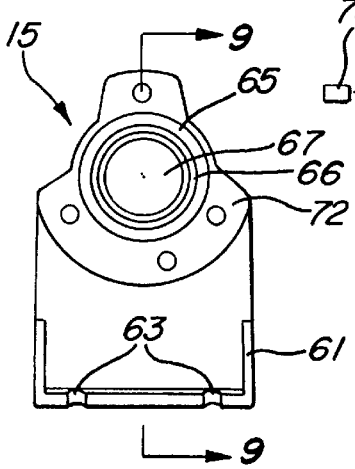
FIG. 8 is a front view of the mounting flange of FIG. 6.
Figure 9:
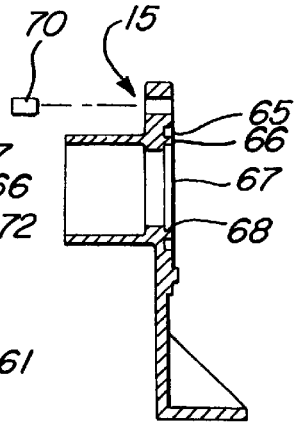
FIG. 9 is a sectional view taken at 9—9 of FIG. 8.

As shown in FIG. 2, the cartridge heater 13 includes a cylindrical heater element 25 centrally mounted to an annular heater flange 27. The exterior cylindrical surface or "sheath" 37 of the heater element 13 is preferably 316L stainless steel, as is the material from which the flange 27 is fabricated. FIG. 5 shows an end view of the mounting flange 27 and illustrates its circular periphery. As further shown in FIG. 5, the flange 27 has suitable mounting holes 28 arrayed on a circle for facilitating attachment to the cartridge heater mounting flange 15.

The heater element 13 includes a central heated zone 31, a first interior "no heat" zone 29, and a second "no heat" zone comprising an end cap 33. The length of the heated zone 31 may be varied to achieve various wattages, and may be 1 to 36 inches, a length of 5.25 inches, for example, being selected for a 1500-watt output.

Figure 3:
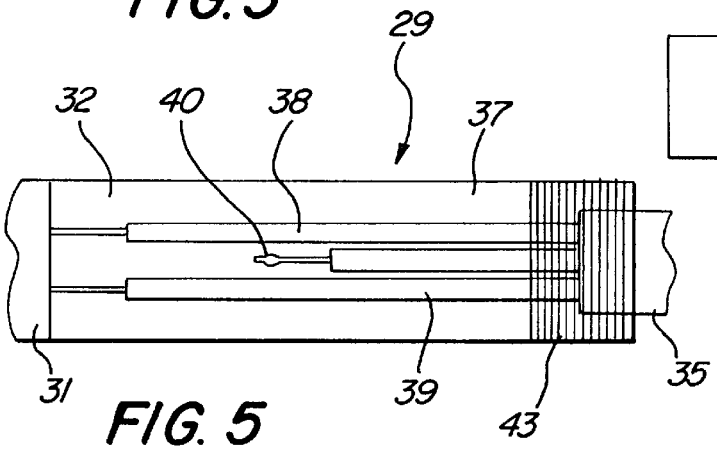
FIG. 3 is a broken-away side view of a portion of the cartridge heater of FIG. 2.

As shown in FIG. 3, the no heat zone 29 includes a hollow interior 32 within the sheath 37 containing a neutral lead 38, a hot lead 39, and a ground lead 40 welded to the sheath 37. A portion of the hollow interior 32 is filled with an epoxy seal 43 surrounding the cable leads 38, 39, 40 and the cable sheath 35.

Figure 4:
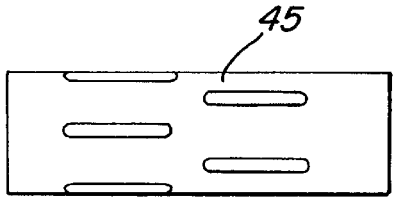
FIG. 4 is a side view of a current collector for use with the cartridge heater of FIG. 2.

FIG. 4 illustrates a vented current collector 45 of cylindrical cross-section, preferably 316L stainless steel, which slips over the heater element 25. The current collector may have an outside diameter of 1.125 inches and is welded, preferably by TIG welding, to the flange 27, concentric with the sheath 37. The end cap 33 and flange 27 are also preferably TIG welded to the sheath 37.

The heater core within the heated zone 31 of the heater element 25 is constructed according to conventional cartridge heater construction. For a 0.75-inch-diameter sheath 37, the core upon which resistance wire is to be wound is preferably selected to be of the diameter used for a ⅝-inch sheath O.D. standard construction heater to meet a low leakage requirement, e.g., 100 microamps or less, while providing a watt density of up to 200 watts/sq. in.

Conventional cartridge heater design consists of electrical resistance wire wound onto an extruded ceramic core material which is precisely located within a heavy gauge cylindrical metal sheath, e.g., 37. This construction method puts the resistance wire relatively close to the sheath 37, which allows greater heat transfer than a tubular heater at any given resistance wire temperature. As just described, the sheath 37 has a TIG welded cap 33 at one end and a TIG welded mounting flange 27 at the other end. The "air space" between the resistance wire and the sheath 37 is then packed with MgO insulation. The integral wire leads 38, 39, 40 and an epoxy potting seal 43 are then installed within the sheath 37. The heater 25 then undergoes a compaction process, known in the art as swaging, which dramatically improves the uniformity of thermal conductivity.

Swaging, when combined with resistance wire-to-sheath proximity, allows the resistance wire to operate at a relatively low temperature. Thus, cartridge heaters are known to provide up to 300 watts/sq. in. of surface area, whereas tubular heaters are limited to about 100 watts/sq. in. Since all welding and metal working processes (with the exception of swaging) are performed during the first stage of manufacture, before the resistance wire and other "sensitive" components are installed, these processes do not jeopardize the thermal or electrical integrity of the cartridge heater 25. In addition, since there is no risk of damaging these other components, the welding and metal working processes may be optimized to provide maximum mechanical integrity.

Because of the cartridge heater's large sheath diameter, heavy gauge construction, and robust mounting features, the vibration amplitude encountered by the heater's interior is less than 12% that of a typical flow-through tubular element. The preferred cartridge heater has been designed with no-heat zones in the two welded areas to further minimize the chances for cracks or corrosion to occur in the weld areas. The cartridge heater 25 in the embodiment shown in FIG. 1 is securely supported at both ends to provide optimum vibration resistance and water flow geometry.

FIGS. 6–9 illustrate the construction of the cartridge heater mounting flange 15 in more detail. The mounting flange 15 is preferably a single-piece injection molded plastic part and includes a rear interconnection member 53 and a base member 51. The rear interconnection member 53 includes a cylindrical pipe section 57 integrally molded with a flange 55 having three holes 59 formed therein at the apices of an equilateral triangle. The base member 51 includes a central opening 67 and base portion 61 having a pair of slots 63 therein for facilitating mounting of the mounting flange 15 to a cooperating surface. A first O-ring cavity 65 is defined by a raised ring 66 formed around the central opening 67. The raised ring 66 further defines a recessed lip 68 about the opening 67, which comprises a second O-ring mounting location.

An innermost O-ring 18 (FIG. 1) is placed adjacent the heater mounting flange 27 of the heater unit 13 and provides a "corking effect" when the heater unit 13 is inserted into the mounting flange 15, thereby compressing the innermost O-ring 18 against the recessed lip 68. A second O-ring 20 (FIG. 1) is further seated in the first O-ring cavity 65 during this operation. A flanged threaded insert 70 such as Helicoil Ultrasert P/N UFB001024 is attached, for example, by sonic welding in each hole 59 and corresponding hole 28, thereby providing a mechanism for attaching the heater flange 27 to the face 72 of the mounting flange 15.

Figure 10:
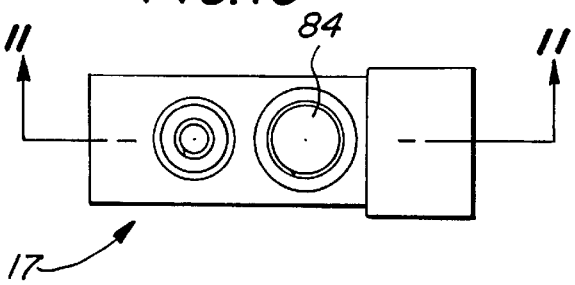
FIG. 10 is a top view of a special tee enclosure component according to the preferred embodiment.
Figure 11:
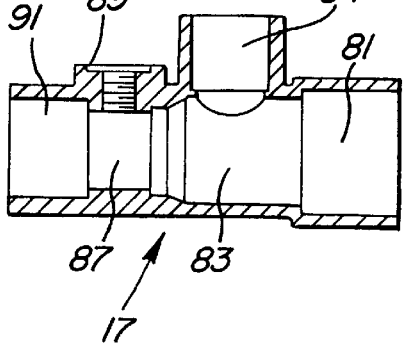
FIG. 11 is a sectional view taken at 11—11 of FIG. 10.

FIGS. 10 and 11 illustrate a special tee member 17 according to the preferred embodiment in more detail. The special tee member 17 includes a cylindrical entrance 81 for receiving the pipe section 57 of the mounting flange 15, a central cylindrical chamber 83 above which lies a vertical "t" pipe section 85 having a circular opening 84, a cylindrical chamber 87 positioned below a threaded boss 89, and a final pipe section 91 for interconnecting to pipe 21 (FIG. 1). The "t" pipe section 85 comprises the outlet for spa water which has been heated and is being pumped into an associated spa. The boss 89 receives a threaded thermistor housing 110 (FIG. 14) for high-limit temperature control, as described in more detail below.

As illustrated in FIG. 11, the internal structure of the special tee 17 gradually narrows in diameter from the chamber 83 to the chamber 87. The chamber 87 may be, e.g., 1.02 inches in diameter for a ¾-inch-diameter heater element concentrically positioned therein. This particular dimensioning provides high velocity water flow, e.g., 40 feet/second about the heater element 25.

Figure 12:
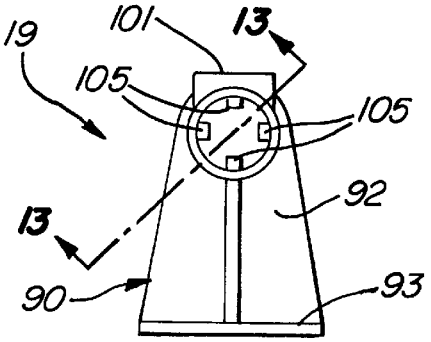
FIG. 12 is an end view of an alignment bushing enclosure component according to the preferred embodiment.
Figure 13:
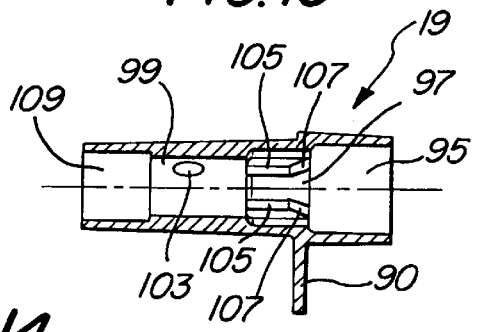
FIG. 13 is a sectional view taken at 13—13 of FIG. 12.

Additional details of the alignment bushing 19 will now be discussed in conjunction with FIGS. 1 and 12–13. The bushing 19 includes a base support 90 having a vertical strut 92 mounted at a right angle to a foot 93, which is preferably rectangular in the horizontal plane. In the end view of FIG. 12, the strut 92 appears generally trapezoidal in shape. The bushing 19 further includes an end pipe section 95 leading into a heater receptacle portion 97 which, in turn, leads into a chamber 99 beneath a boss 101 having a hole 103 therein.

The heater receptacle portion 97 includes four guide fingers 105 equally spaced 90 degrees apart around its cylindrical interior. The fingers 105 each have a chamfered interior end surface 107 for receiving the end 33 of the heater tube 25 and guiding it into the fingers 105, which thereby concentrically position the heater tube 25 within the bushing 19.

The hole 103 in the boss 101 receives a thermistor housing 110 for temperature regulating control. The housing 110 extends into the pipe section 91, as described further below. The pipe section 91 leads into an end pipe section 109, which may receive a barbed adapter insert 108 (FIG. 1). The bushing 19 is preferably a unitary molded part formed by injection molding of heat-resistant PVC.

Figure 14:
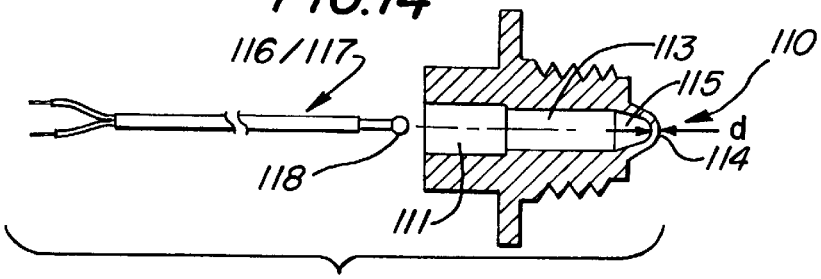
FIG. 14 is a side sectional view of a thermistor housing according to the preferred embodiment.

FIG. 14 illustrates a thermistor housing 110 according to the preferred embodiment. This element is preferably an injection molded chlorinated PVC part having concentric interior bores 111, 113 for accommodating a thermistor element such as Fenwall Electronics Part No. 192-103LET-A01. The thermistor element and its wire assembly are potted in the space provided by bores 111, 113. The temperature sensing end of the thermistor element is located in the hemispherical interior tip portion 115 of the housing 110. The thickness "d" of the wall 114 of tip portion 115 is made sufficiently thin, e.g., 0.030-inch, to provide efficient heat transfer between heated water in the chambers 87, 99 and the thermistor element located within the thermistor housing 110. Thermistor housings 110 with different threads (e.g., ⅝-inch and ½-inch insert plugs) may be provided for the high-limit and regulating controls according to the preferred embodiment, to avoid confusion during assembly. The heated zone 31 of the heater element 13 may be varied to achieve various wattage outputs for various spa models, as discussed above.

As shown in FIG. 1, first and second thermistor elements 116, 117 are provided in respective first and second housings 110 disposed on either side of the heated zone 31 of the heater element 25. The second thermistor 117 forms part of a control loop, which turns the power to the heater element 25 via cable (not shown) on and off to maintain a desired temperature. The first thermistor 116 is part of a high-limit thermostat loop, which shuts off the heater element 25 in the event that the thermostat circuit including the first thermistor 117 fails.

The positioning of the first thermistor 116 just before the current collector 45 also provides for quickly sensing a rise in temperature in the event there is no water in the heater 11 (dry fire condition). Such sensing is critical to using a plastic housing safely, particularly if the heater 13 is not operating in conjunction with a flow switch which interrupts the energy supply to heater 13 when a no-water-flow condition is sensed. In the preferred embodiment under discussion, the tip 114 of the sensor housing 110 is positioned 60/1000-inch from the sheath 37 of the heater element 25 and just in front of the end of the current collector 45, a placement which is essential for rapid response.

In addition, a high-temperature chlorinated PVC is preferred for fabrication of all the enclosure components shown in FIG. 1, including the mounting flange 15, polymer pipe 21, special tee section 17, alignment bushing 19, and the thermistor housings 110. The minimum preferred chlorinated PVC has a V. O. flammability rating including a deflection temperature rating of 264 psi at 210° F. Such plastic has the advantage that it will not sustain combustion or drip in the event of a dry fire and will not deform in the event water within the unit boils.

According to the preferred embodiment, turbulent flow, which increases heat transfer efficiency, is optimized by, water pumped by a spa pump 210 into the end of the heater 11 provided by the alignment bushing 19 (left end in FIG. 1), as reflected by the arrow in FIG. 1. The flow stream transitions to highly turbulent flow because of three irregularities in the flow path: (1) heater positioning "finger" design; (2) the shape of the end of the heater, which may be flat or concave, and is normal to the water flow path; and (3) the change (in the illustrative embodiment) from ¾-inch circular pipe flow to ¾-inch I.D.×1-inch O.D. annular flow. Heated water then flows out of pipe section 85, as reflected by arrow 112. As will no doubt be apparent to those skilled in the art, the successive parts 19, 21, 17, 15 of the enclosure sealingly interconnect with one another to form a continuous, sealed fluid flow path. This may be accomplished by suitably gluing together the appropriate interfitting pipe segment portions of the alignment bushing 19, pipe 21, special tee 19, and mounting flange 15.

Figure 15:
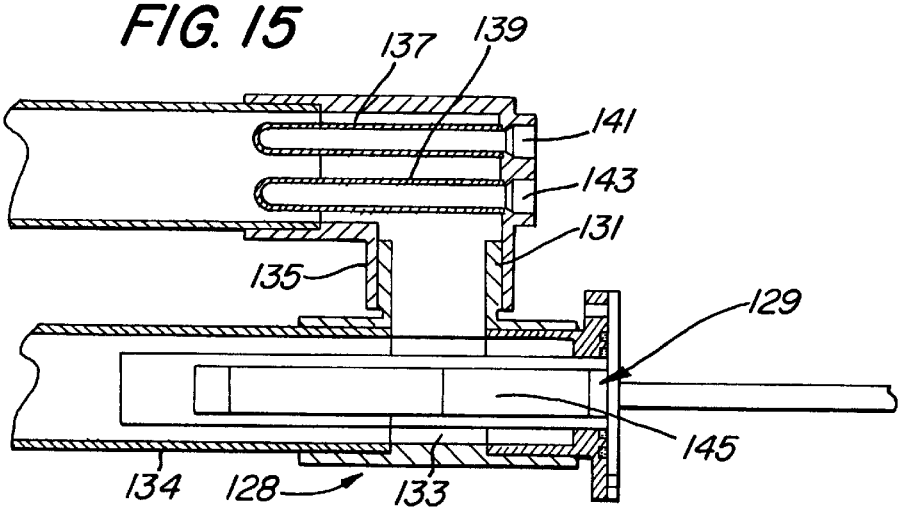
FIG. 15 is a side sectional view of a cartridge heater and enclosure according to a second embodiment.

FIG. 15 illustrates an alternative cartridge heater system embodiment. This embodiment includes a mounting flange section 125 providing a flange 127, which mounts a cartridge heater element 129. A "tee" section 128 provides a vertical tee pipe segment 131 opening out of a cylindrical horizontal pipe chamber 133. A piece of PVC pipe 134 extends out of the horizontal chamber 133. The vertical pipe segment 131 is attached to a right angle pipe section 135 within which two test tube-shaped projections 137, 139 are positioned side by side and parallel to one another. The area surrounding the test tubes 137, 139 comprises a "thermo well." Thus, the projections 137, 139 may contain spa control equipment such as mechanical or electronic sensing bulbs for temperature regulating or high-limit controls. The tubes 137, 139 are watertight and have circular openings at 141, 143 at one end thereof.

In the embodiment of FIG. 15, the heater element 129 is short enough that it does not require support by an alignment bushing as shown in FIG. 1. Such a heater element 129 may have a heated length ("31" in FIG. 2) of 3.25 inches. A thermal fuse 145 may also be inserted in series with the hot lead, e.g., 39 (FIG. 2), to provide protection against dry fire in case of all other control system failures. Protection, in addition to the thermal fuse, may include water flow or pressure switches and temperature sensing controls.

Those skilled in the art will appreciate that various adaptations and modifications of the just-described preferred embodiment can be configured without departing from the scope and spirit of the invention. Therefore, it is to be understood that, within the scope of the appended claims, the invention may be practiced other than as specifically described herein.

What is claimed is:

1. Spa water heater apparatus comprising:

a single linear cylindrical cartridge heater; and an enclosure means fabricated of plastic having a first end including a fluid entrance and a second end including a fluid exit and an entirely linear segment therebetween for enclosing said linear cartridge heater and for directing a flow of water about said heater, said plastic enclosure means further comprising at said first end constriction means including a tubular structure comprising a cylindrical flow path of a first outside diameter leading to an annular flow path of a second outside diameter about said cartridge heater for accelerating the flow of water about said cartridge heater so as to cause heating of said water by said cartridge heater without boiling said water.

2. The apparatus of claim 1 wherein said plastic is a high-temperature chlorinated polyvinyl chloride.

3. The apparatus of claim 1 further including a current collector means mounted adjacent said cartridge heater within said enclosure means.

4. The apparatus of claim 3 wherein said current collector means comprises a cylindrical metal collector element positioned about said cartridge heater.

5. The apparatus of claim 4 wherein said linear cartridge heater includes a cylindrical tube attached to an annular mounting flange and wherein said cylindrical metal collector element is attached to said flange concentrically about said tube.

6. The apparatus of claim 5 wherein said cylindrical tube includes a heated zone between two no heat zones, the first no heat zone comprising a welded end cap, and the second no heat zone being located at an end of said tube which is welded to said flange.

7. The apparatus of claim 6 wherein said heated zone comprises compressed magnesium oxide (MgO).

8. The apparatus of claim 1 wherein said enclosure means comprises:

mounting flange means for mounting a first end of said heater; and alignment bushing means adapted to mount said heater to a generally flat surface for receiving a second end of said heater and aligning said heater within said enclosure means.

9. The apparatus of claim 1 wherein said enclosure means comprises:

a unitarily-molded plastic alignment bushing connected to a first end of said tubular structure and having means therein for receiving a first end of said heater, for centrally positioning said heater within said enclosure means, and for receiving water to be heated and conducting it to and past said first end of said heater; and a unitarily-molded plastic tee element means connected to a second end of said tubular structure and having a temperature sensor mounted therein said tee element means for passing heated water which has passed through said alignment bushing past said temperature sensor and for thereafter discharging said heated water.

10. The apparatus of claim 9 wherein said temperature sensor is positioned within 0.060-inch of said heater to sense rapid rise in temperature to thereby provide dry fire protection.

11. The apparatus of claim 1 wherein said heater has a flat mounting flange, a cylindrical heater element extending from said flat mounting flange, and an O-ring mounted adjacent said flat mounting flange, and wherein said enclosure means includes a plastic mounting flange having means thereon for cooperating with said O-ring to achieve a corking effect when said heater element and said O-ring are mounted into said plastic mounting flange means.

12. The apparatus of claim 11 wherein said heater has a cylindrical current collector welded to said flat mounting flange and wherein said O-ring is mounted about said current collector.

13. The apparatus of claim 1 wherein the said flow of water about said cartridge heater is at a rate of 40 feet per second.

14. Heater apparatus for heating water contained in a spa, whirlpool, or other fluid reservoir comprising:

a cartridge heater having an entirely linear cylindrical heater element;

a current collector mounted to surround a selected portion of said linear heater element; and a fire retardant watertight polymer housing enclosing said heater element and said current collector and spaced apart from said heater element, said housing having:

first and second ends, a first opening in said first end for receiving water to be heated, a second opening in said second end for discharging heated water, and a tubular structure located between said first and second openings and having a first portion having a circular interior cross-section of a first diameter and a second portion having a circular interior cross-section of a second diameter, said second portion surrounding said cylindrical heater element, said heater element having an outside diameter less than said second diameter, said tubular structure thereby providing a cylindrical flow path of said first diameter at said first end leading to an annular flow path about said cylindrical heater element, said annular flow path having an outer diameter equal to said second diameter.

15. The heater apparatus of claim 14 further including:

first and second temperature sensing probe means installed in said housing, said first probe means for providing high-limit and dry fire temperature protection, said second probe means for regulating water temperature.

16. The heater apparatus of claim 15 wherein said cartridge heater includes a sheath containing high-pressure compacted magnesium oxide (MgO).

17. The heater apparatus of claim 16 further including pump means for pumping water into said first opening, through said housing, and out said second opening.

18. The apparatus of claim 14 wherein said housing comprises:

a unitarily-molded plastic alignment bushing connected to a first end of said tubular structure having means therein for receiving a first end of said heater, for centrally positioning said heater within said fire retardant polymer housing and for receiving water to be heated and conducting it to and past a first end of said heater; and a unitarily-molded plastic tee element means connected to a second end of said tubular structure and having a temperature sensor mounted therein, said tee element means for passing heated water which has passed through said alignment bushing past said temperature sensor and for thereafter discharging said heated water.

19. The apparatus of claim 14 wherein said heater element has a first end and wherein said housing includes a bushing means for positioning and retaining said first end of said heater element.

20. The spa water heater apparatus of claim 1 further including means for creating turbulence in the water flow about said cartridge heater so as to increase the transfer of heat away from said heater.

21. The spa water heater apparatus of claim 20 wherein said means for creating turbulence comprises a plurality of fingers located in said cylindrical flow path.

22. The spa water heater apparatus of claim 21 wherein said fingers are so positioned and shaped as to receive and align an end of said cartridge heater.

23. The spa water heater apparatus of claim 20 wherein said means for creating turbulence is located within said cylindrical flow path.

24. A cartridge heater system comprising:

an annular heater flange;

a cylindrical cartridge heater element mounted to said heater flange and having first and second ends and an axis;

an alignment bushing comprising a webbed support member and guide means for receiving and positioning said second end of said cylindrical cartridge heater element therein, said alignment bushing further comprising a generally cylindrical interior flow path of a first outside diameter and means for receiving fluid in a direction parallel to the axis of said cylindrical cartridge heater element and conducting said fluid in said direction to said cylindrical cartridge heater element;

first temperature measuring means disposed in said alignment bushing for measuring the temperature of said fluid prior to exposure to said cylindrical cartridge heater element;

a cartridge heater mounting flange comprising a webbed support member and a face plate disposed perpendicular to said cylindrical cartridge heater element, said cartridge heater mounting flange including means for mounting said annular heater flange thereto, said face plate having a cylindrical pipe section extending therefrom;

a tee member having means for receiving said cylindrical cartridge heater element therein, means for sealingly receiving said cylindrical pipe sections, and means for receiving said fluid in said direction parallel to said axis of said cylindrical cartridge heater element and expelling said fluid in a direction perpendicular to said axis of said cylindrical cartridge heater element;

second temperature measuring means disposed in said tee member for measuring the temperature of said fluid subsequent to exposure to said cylindrical cartridge heater element; and a cylindrical tube means for receiving said cartridge heater element and forming an annular fluid flow path thereabout extending between said alignment bushing and said tee member, said tube means further providing an annular flow path of a second outside diameter about said heater element, said annular flow path being connected to said cylindrical flow path such that said tube means and alignment bushing cooperate to accelerate the flow of fluid past said cartridge heater element so as to cause heating of said fluid without boiling.

25. The apparatus of claim 24 wherein the said flow of fluid about said cartridge heater is at a rate of 40 feet per second.

* * * * *